US010881943B2

(12) United States Patent
Isserow et al.

(10) Patent No.: US 10,881,943 B2
(45) Date of Patent: Jan. 5, 2021

(54) PROTECTIVE HEADGEAR WITH ADJUSTABLE FACESHIELD

(71) Applicants: Jonathan Isserow, Basking Ridge, NJ (US); Laura Isserow, Basking Ridge, NJ (US); Lauren Isserow, Basking Ridge, NJ (US); Michael Isserow, Basking Ridge, NJ (US); David Isserow, Basking Ridge, NJ (US)

(72) Inventors: Jonathan Isserow, Basking Ridge, NJ (US); Laura Isserow, Basking Ridge, NJ (US); Lauren Isserow, Basking Ridge, NJ (US); Michael Isserow, Basking Ridge, NJ (US); David Isserow, Basking Ridge, NJ (US)

( * ) Notice: Subject to any disclaimer, the term of this patent is extended or adjusted under 35 U.S.C. 154(b) by 52 days.

(21) Appl. No.: 16/243,122

(22) Filed: Jan. 9, 2019

(65) Prior Publication Data

US 2019/0209912 A1 Jul. 11, 2019

Related U.S. Application Data

(60) Provisional application No. 62/616,083, filed on Jan. 11, 2018.

(51) Int. Cl.

| | |
|---|---|
| ***A63B 71/10*** | (2006.01) |
| ***A42B 3/20*** | (2006.01) |
| ***A42B 3/18*** | (2006.01) |

(52) U.S. Cl.

CPC ..... *A63B 71/10* (2013.01); *A42B 3/18* (2013.01); *A42B 3/20* (2013.01); *A63B 2209/02* (2013.01)

(58) Field of Classification Search

CPC ..... A63B 71/10; A63B 2071/105; A63B 2209/02; A42B 3/222; A42B 3/223;

(Continued)

(56) References Cited

U.S. PATENT DOCUMENTS 1,449,183 A * 3/1923 Johnstone ..... A63B 71/10 2/9
1,488,812 A * 4/1924 Goodman ..... A63B 71/10 2/9

(Continued)

FOREIGN PATENT DOCUMENTS

| | | |
|---|---|---|
| EP | 1136007 | 4/2005 |
| WO | 2014146645 | 9/2014 |

*Primary Examiner* — Amy Vanatta
(74) *Attorney, Agent, or Firm* — Gearhart Law LLC

(57) ABSTRACT

A protective cap is described. The protective cap includes a protective case having a padded inner surface and a rigid outer cover. The rigid outer cover includes a forward facing portion. The forward facing portion includes an aperture having a width approximately equal to a width of the forward facing portion. The protective cap also includes a pair of side facing portions and an optional head cover fitting. The optional head cover fitting is attached to the protective case, and an optional face shield. The optional face shield is connected to a track located on a pair of side facing portions of the protective case. The outer shell includes variable transparency and/or opaqueness allowing a visualization of information, such as a team logo, on a separately worn traditional baseball/other sports cap. Alternatively a logo/design is applied directly to the outer shell of the protective cap.

18 Claims, 4 Drawing Sheets

(58) Field of Classification Search
CPC .. A42B 3/06; A42B 3/125; A42B 3/12; A42B 3/28; A42B 3/08; A42B 3/20; A42B 3/22; A42B 3/205; A42B 3/18; A42B 1/18; A42B 1/02; A42B 3/003; A42B 3/0406; A42B 3/221; A42B 3/227; A41D 13/05; A41D 13/11
USPC ..... 2/9
See application file for complete search history.

(56) References Cited

U.S. PATENT DOCUMENTS

| | | | | | |
|---|---|---|---|---|---|
| 2,627,602 | A * | 2/1953 | Goldsmith | A63B 71/10 | 2/9 |
| 3,167,783 | A | 2/1965 | Wolfe | | |
| 3,373,443 | A * | 3/1968 | Marietta | A42B 3/20 | 2/9 |
| 3,551,910 | A | 1/1971 | Raschke | | |
| 3,608,089 | A * | 9/1971 | Abbatelli | A42B 3/20 | 2/9 |
| 3,886,596 | A | 6/1975 | Franklin et al. | | |
| 4,581,775 | A * | 4/1986 | Nava | A42B 3/24 | 2/424 |
| 4,660,230 | A | 4/1987 | Weissenberger et al. | | |
| 4,726,074 | A | 2/1988 | Baclit et al. | | |
| 4,933,993 | A | 6/1990 | McClelland | | |
| 5,206,955 | A * | 5/1993 | Milligan | A42B 3/20 | 2/424 |
| 5,226,180 | A | 7/1993 | Leach | | |
| 5,392,468 | A | 2/1995 | Leddick, II | | |
| 5,477,565 | A | 12/1995 | Hunt, Jr. | | |
| 5,481,759 | A | 1/1996 | Rinaldi | | |
| 5,519,895 | A | 5/1996 | Barnes, Jr. | | |
| 5,571,220 | A | 11/1996 | Hall | | |
| 5,661,849 | A | 9/1997 | Hicks | | |
| 5,694,649 | A | 12/1997 | Hefling et al. | | |
| 5,893,174 | A | 4/1999 | Primeau | | |
| 5,966,744 | A | 10/1999 | Smith, Jr. | | |
| 5,987,651 | A * | 11/1999 | Tanaka | A42B 3/223 | 2/424 |
| 6,047,409 | A * | 4/2000 | Simpson | A42B 3/223 | 2/424 |
| D479,019 | S | 8/2003 | Lishen et al. | | |
| 6,708,339 | B1 | 3/2004 | Smith, Jr. | | |
| 6,983,487 | B2 * | 1/2006 | Rickon | A42B 3/20 | 2/9 |
| D575,458 | S | 8/2008 | Ho | | |
| 7,430,763 | B1 | 10/2008 | Santos | | |
| 7,900,268 | B2 | 3/2011 | Mahan | | |
| 8,001,624 | B1 | 8/2011 | Leedom | | |
| 8,387,169 | B2 | 3/2013 | Shockman | | |
| 8,769,727 | B1 | 7/2014 | Hester | | |
| 9,480,294 | B2 | 11/2016 | Occhipinti | | |
| D774,283 | S | 12/2016 | Rollins | | |
| 9,572,390 | B1 | 2/2017 | Simpson | | |
| 9,693,594 | B1 | 7/2017 | Castro et al. | | |
| 2003/0070200 | A1 | 4/2003 | Crye et al. | | |
| 2005/0086727 | A1 | 4/2005 | Shen | | |
| 2005/0278835 | A1 | 12/2005 | Ide et al. | | |
| 2008/0092279 | A1 | 4/2008 | Chiang | | |
| 2009/0191989 | A1 * | 7/2009 | Lammer | A42B 3/063 | 473/535 |
| 2010/0186151 | A1 | 7/2010 | O'Leary | | |
| 2011/0252545 | A1 | 10/2011 | Irrgang et al. | | |
| 2011/0271430 | A1 | 11/2011 | Lowe et al. | | |
| 2012/0260405 | A1 | 10/2012 | Shen | | |
| 2012/0260406 | A1 | 10/2012 | Green et al. | | |
| 2014/0020153 | A1 * | 1/2014 | Romanski | A42B 1/004 | 2/206 |
| 2015/0040296 | A1 | 2/2015 | Hanson et al. | | |
| 2015/0143669 | A1 | 5/2015 | Pereira et al. | | |
| 2015/0335093 | A1 | 11/2015 | Curci et al. | | |
| 2016/0271482 | A1 | 9/2016 | Garland et al. | | |
| 2016/0360819 | A1 | 12/2016 | Summerville | | |

* cited by examiner

PROTECTIVE HEADGEAR WITH ADJUSTABLE FACESHIELD

CLAIM OF PRIORITY

This application claims priority to U.S. Application Ser. No. 62/616,083 filed on Jan. 11, 2018, the contents of which are herein incorporated by reference in its entirety.

FIELD OF THE EMBODIMENTS

The field of embodiments of the present invention relate to a device for protecting the face and head, especially during playing various ball sports.

BACKGROUND OF THE EMBODIMENTS

Several sporting leagues have recently begun to investigate and handle their players head injuries in a more detailed and careful way than in the past. The sporting leagues have begun holding a player out after a suspected concussion and ensure that the player does not come back into the field of play until the player is medically cleared. Several teams have started to protect some of their most important assets by ensuring that they are better protected as well. Some baseball pitchers have even begun wearing additional protection to prevent the concussions from happening in the first place. This has resulted in various improvements in head protection, but leaves much to be desired.

U.S. Pat. No. 5,661,849 pertains to a protective face guard for softball players. The face guard is made of rigid, curved bars interconnected by vertical struts to form a concave shield around a player's face. The guard has a downwardly oriented visual aperture corresponding to a clear tracking field of sight for softball players to visually track a pitched softball approaching from a low pitched ball release point.

U.S. Pat. No. 5,571,220 pertains to protective headgear for baseball fielders specifically including a helmet having a cap portion and a faceguard.

U.S. Pat. No. 4,660,230 pertains to a baseball batting helmet with an outer shell which projects over at least one of a batter's ears and has webbing and/or padding on the interior side of the shell to cushion the helmet against the batter's head.

U.S. Pub. 2012/0260406 pertains to a protective insert adapted to convert a standard baseball cap into a protective head guard, while maintaining the cap's desired attributes, such as comfort and stability. The protective insert of the present invention in combination with a baseball cap, not only protects a wearer from head injuries caused by impact force, but also has the attributes of stability, light weight and comfort so that it may be worn for extended periods during more intense activity than conventional baseball helmets.

U.S. Pat. No. 9,693,594 pertains to a protective device for a head of an individual person that includes a flexible headpiece and a segmented outer protective shell disposed about the flexible headpiece for distributing an impact load. The device covers and protects the front, top, sides and back of the head from impact injuries and rebound effects of high speed objects as seen for example, a baseball or softball moving at a speed of up to about 125 mph.

U.S. Pub. 2005/0086727 pertains to a ball cap shield adapted for use with a baseball cap or caps used in other sports is disclosed to protect a pitcher or fielder from a batted or thrown baseball or softball. A panel is shaped to conform to a front surface of a ball cap and is secured with straps or other means on the outer surface of the ball cap or, alternatively, on the inner surface of the ball cap. The shield is formed of a sheet or panel of impact absorbing plastic that protects the user from trauma in the event of a collision with a traveling ball or other object.

However, none of the art described above address all of the issues that the embodiments of the present invention do. A need still exists for a comfortable protective system, which can be combined with the players own cap regardless of the size and shape of the head and face and any additional headwear worn by the player.

SUMMARY OF THE EMBODIMENTS

The present invention and its embodiments are generally related to protecting a ball player, preferably a baseball, cricket, softball player, or golf, squash and other racket sport or any sport which includes projectiles during play. The protective head gear system can be coupled with a player's existing ballcap or other article of headwear, and continue to show the emblems and logos of the player's team. Embodiments of the present invention include a protective cap having a protective case with a padded inner surface and a rigid outer cover. The rigid outer cover may comprise a variety of materials including polycarbonates, pliable plastics or carbon fibers as well as carbon nanofibers. The padded inner surface can cover between about 180 to about 360 degrees of an inner surface of the protective case. The rigid outer cover may have a forward facing portion with an aperture having a width approximately equal to a width of the forward facing portion. The forward facing portion is reinforced. The aperture may preferably be between about 0.5 cm and about 1 cm.

The rigid outer cover may also have a pair of side facing portions. Padding may also adhere to the inner surface of the protective shell. A chin strap may be connected to the pair of side facing portions. The protective cap can also include a head cover fitting within and being coupled to the protective case, and a face shield being coupled to at least one track being located on at least one of the pair of side facing portions of the protective case and the face shield being moveable in an aft-forward direction. The head cover can include a rear opening and top opening. In some embodiments, the head cover is formed from Kevlar or can be a material such as an ABC-Matrix, or similar material. Also, the protective cap can include at least two open channels on an inner surface forming at least a pair of coupling sections between the head cover and the rigid outer cover. The protective cap can be removable and be attached by a hook and loop system, or by a fastener. The cap may be washable, and may provide applications of cooling or warming a player's head during use.

It is another object of the embodiment of the present invention to have at least a first and second portions of the protective case be light permeable. A level of light permeability may range from fully transparent to fully opaque.

It is yet another object of the embodiment of the present invention to have the face shield be coupled to the protective case with a pair of hinges. The pair of hinges allows rotational movement of the face shield. The pair of hinges can have a lock on the pair of hinges allowing locking of the face shield in multiple lateral and rotational positions.

It is yet another object of the embodiment of the present invention to have an inner surface of the side facing portions covered with a padding material, the padding material can overlap with an edge of the face shield.

It is yet another object of the embodiment of the present invention to have the head cover and the protective case be of different materials.

It is yet another object of the embodiment of the present invention to have the aperture be uninterrupted.

It is yet another object of the embodiment of the present invention to have the rigid outer cover include a rear opening. A width of the rear opening may be shorter than the width of the aperture. The rear opening can be uninterrupted along a height of the rigid outer cover. A strap or other fixation device can span the rear opening. The strap can be fixed to the protective case at a first end and be removably coupled to the protective case at a second end.

In addition to the foregoing, other objects, features, aspects and advantages of the embodiments of the present invention will be better comprehended through a careful reading of a detailed description provided herein below with appropriate reference to the accompanying drawings.

DESCRIPTION OF THE PREFERRED EMBODIMENTS

Figure 1:
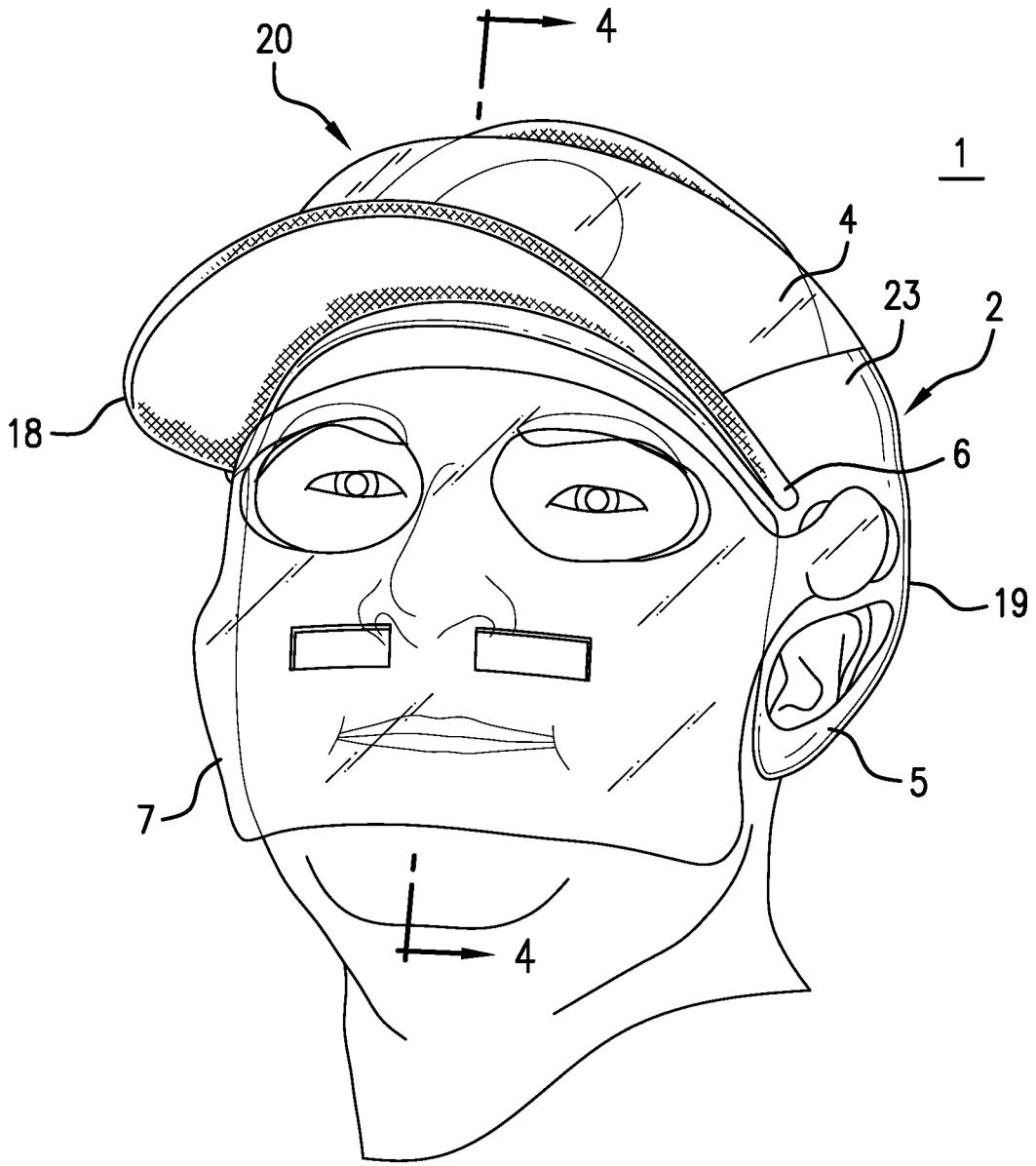
FIG. 1 shows an isometric frontal view of an embodiment of the invention.
Figure 2A:
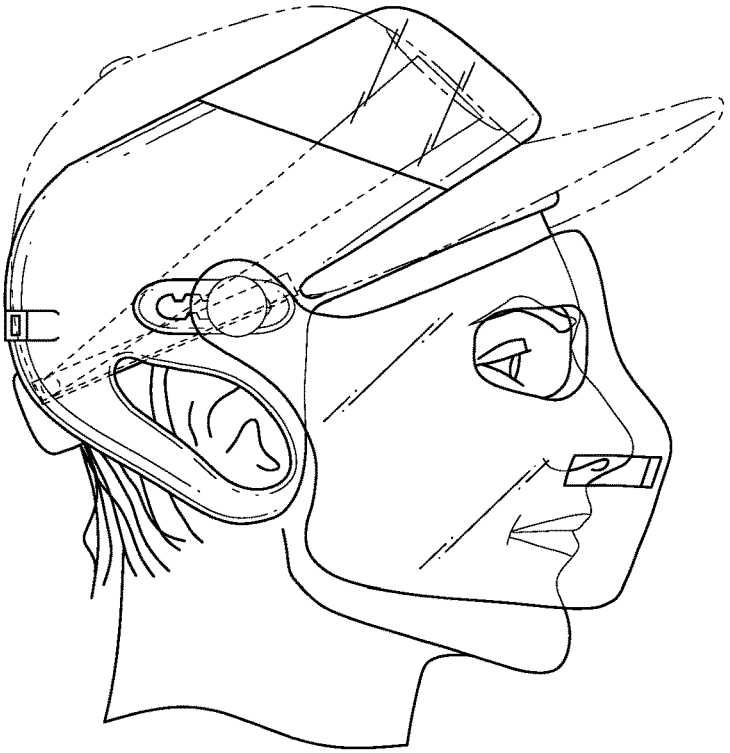
FIG. 2*a* shows a side view of an embodiment of the invention.
Figure 2B:
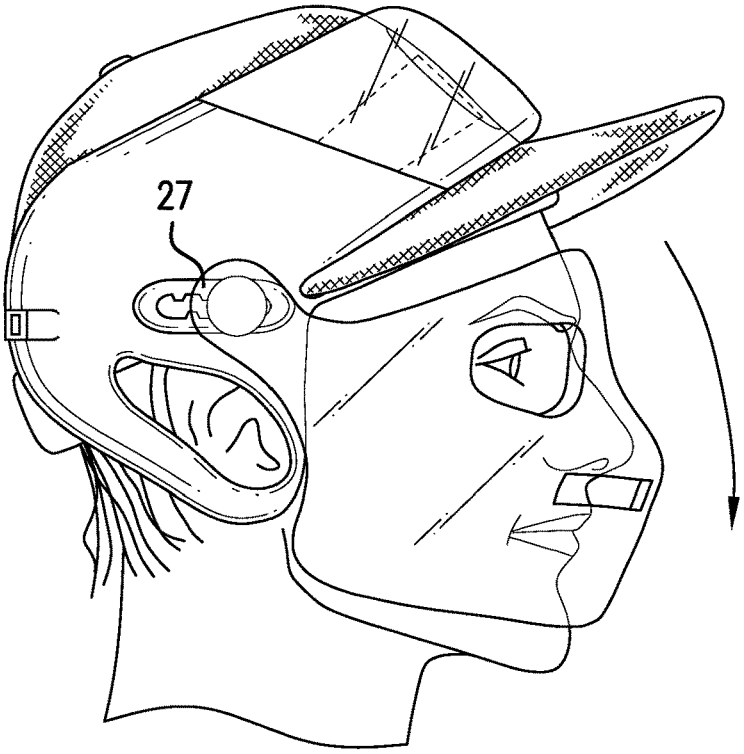
FIG. 2*b* shows a side view of an embodiment of the invention with the shield in an alternate position.
Figure 3A:
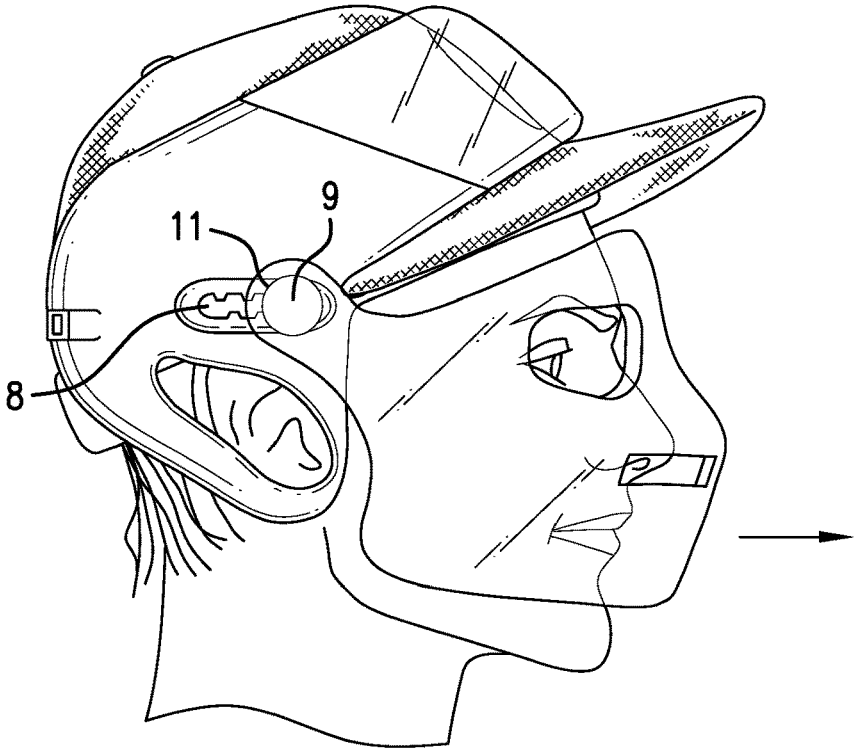
FIG. 3*a* shows a side view of an embodiment of the invention.
Figure 3B:
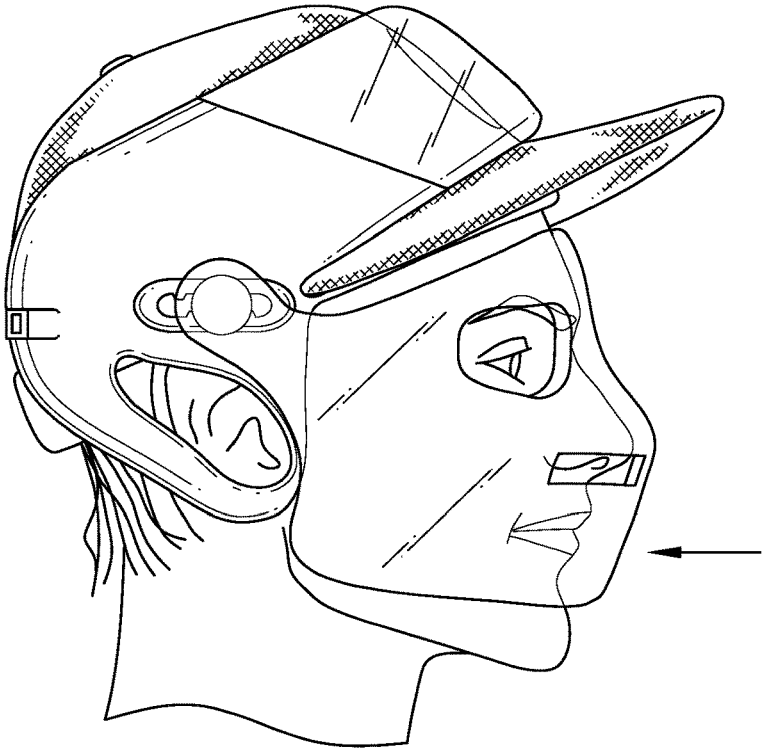
FIG. 3*b* shows a side view of an embodiment of the invention with the shield in an alternate position.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

The present invention and its embodiments are related to protecting a player, preferably a baseball, cricket, softball, golf, squash, or participants of other sports involving from being hit in the head by a ball or other projectile. Inventive concepts applicable in ball playing scenarios can be extrapolated and applied in other fields as well. One of the benefits of the embodiments of the present invention is the protective head gear system can be coupled with a player's existing ballcap, and continue to show the player's teams' emblems and logos. Presently, there is a big push by various sporting leagues, Major League Baseball included, to protect the pitcher when they are in a defenseless position right after a pitch is thrown. At times, a pitcher can have a baseball flying back at them just as fast as it was thrown by them a split second before. Similarly a bowler or wicket keeper in cricket may be vulnerable to being struck by a ball or other object. Fielders may also be at risk in ball sports from being struck by projectiles. The present invention and its embodiments allow for improved protection while also giving the benefit of comfortable fit and improved interchangeability. The system is adjustable, and the system employs an already present cap that a player would wear regularly and couples the cap with the headgear system.

As can be seen in FIG. 1, the system can comprise a protective cap 1 having a protective case 2 with a padded inner surface 3 (see FIG. 4) and a rigid outer cover 19 coupled with a player's headwear 18. The protective cap 1, can include the padded inner surface 3 covering between about 180 to about 360 degrees of an inside of the protective case. Preferably the padded inner surface 3 covers between 180 and 270 degrees of the inside, allowing for a gap in the back of the protective cap 1 where players' existing cap would be able to enter. Furthermore, the padded inner surface 3 may include a foam-based material and an origami like material.

The rigid outer cover 19 can also have a forward facing portion 20 with an aperture 6 having a width approximately equal to a width of the forward facing portion. The aperture can extend from nearly one end of the forward facing portion to the other end of the forward facing portion, leaving a small structural edge as the forward portion flows into the side portion, this structural portion can be between 0.1 cm and 2 cm wide. This aperture is placed strategically in order to receive the bill of the players existing hat or headwear 18. The aperture 6 can have a thickness of between about 0.5 cm and about 3 cm, or just wide enough to receive a flat bill or a curved bill. The thickness of the aperture 6 may include a value from a range of 1 cm to 3 cm, preferably. The aperture 6 can be flat or curved to better align with the bill of the cap.

Figure 5:
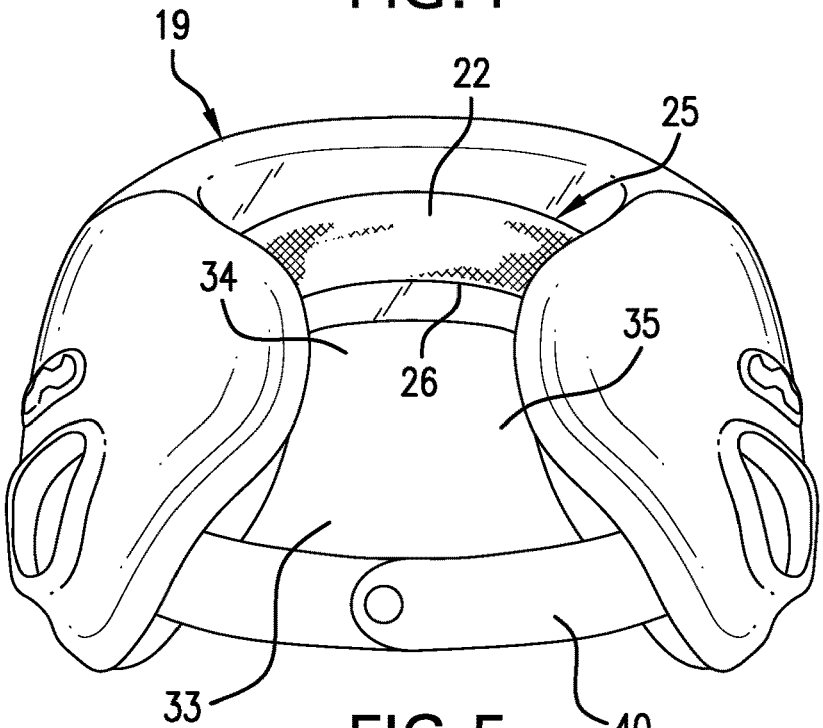
FIG. 5 shows a rear view of an embodiment of the invention.

The protective case 2 can include a rear opening 35, as seen in FIG. 5, making it easier to insert a cap and making the protective cap 1 more breathable and easily adjustable. The rear opening 35 should be shorter than the width of the aperture 6, so that it holds a typical hat inside securely. The rear opening 35 can be uninterrupted along a height of the rigid outer cover 19. A strap 40 can span the rear opening. The strap 40 can be fixed to the protective case 2 at a first end and be removably coupled to the protective case 2 at a second end. The strap can also be fixed at both ends have a crank to make the case tighter or more loose. The strap 40 may also be removably attached to the protective case 2.

As further seen in FIG. 1, the first portion 4 of the rigid outer cover 19 and a second portion 23 can be light permeable. A level of light permeability may range from fully transparent to fully opaque. Furthermore, the permeable portions may also be colored with a single color or a combination of multiple colors. Alternatively, the right outer cover 19 may include the level of light permeability. The level of light permeability may allow a team logo to be visible through the right outer cover 19. Alternatively, the team log may be applied on the right outer cover. A benefit of having a transparent portion is that the protective cap 1 does not have to be customized for any team in particular. The protective cap 1 can be mass produced and worn with any cap, and still show the required logos and emblems that are required to be shown due to TV contracts and player/team preference. As preferred the protective cap may be opaque and match the team coloring and logo.

The rigid outer cover 19 can also have a pair of side facing portions 5. The pair of side facing portions 5 may help protect the player from the side, when the head is turned at the end of a pitch. The pair of side portions 5 should extend vertically down to cover the ears and possibly the jaw of the player. The pair of side portions 5 can include a microphone or speaker to have directions and instructions patched into the player or person wearing the headgear, depending on the application. Sections of the padded inner surface 3 may cover the pair of the side facing portions 5. Furthermore, a chinstrap (not shown) may be attached to the pair of the side facing portions 5.

The protective cap 1 can also include a head cover 22 fitting within and being coupled to the protective case 2. The head cover 22 can be seen in FIGS. 4 and 5. The head cover 22, can have a front opening, a rear opening 33, and a top opening 34. The openings (33 and 34) may simplify an insertion of a preexisting hat, while at the same time providing the necessary amount of protection in the most sensitive areas. The head cover 22 can be made of a number of various materials. One material which is preferable and can withstand impact is Kevlar or similar type material used to make the head cover 22. Other materials including foam-based materials and folded material may also be used to make the head cover 22. A para-aramid synthetic fiber may also be used to make the head cover 22. The head cover 22 and the protective case 2, can be composed of different materials. The benefit of this is that the outer material needs to react better to scratching and to dissipate initial impact better, whereas the inner material needs to be more comfortable and be better at absorbing heat that could be coming of someone's head.

Also, the protective cap 1 can include at least one and preferably two open channels 25 at an inner surface forming at least a pair of coupling sections 26 between the head cover 22 and the rigid outer cover 19. The two open channels 25 make the landing areas that will hold up the pre-existing cap of the player. Two channels are preferable as they can be positioned on the sides of the case 2, and create a three point support system for the pre-existing cap along with the aperture 6 and the bill. The head cover 22 can be attached to the protective case either by an adhesive or by fasteners.

A face shield 7 may also be attached to the track(s) along the pair of the side facing portions 5 of the protective case 2. The face shield 7 may include materials based on steel, titanium, and/or polycarbonate, among others. In another example scenario, the face shield 7 may be transparent.

As can be seen from FIGS. 2*a*, 2*b*, 3*a* and 3*b* the face shield 7 (see FIG. 1) can be coupled to at least one track 8 being located on at least one of the pair of side facing portions 5 of the protective case 2. The face shield 7 may also be moveable in an aft-forward direction. Furthermore, the face shield 7 may be rotatable about the attachment points.

The face shield 7 can be coupled to the protective case with a pair of hinges 27. The pair of hinges 27 allows rotational movement of the face shield. The pair of hinges 27 can have a lock allowing locking of the face shield in multiple lateral and rotational positions. It is beneficial to have a rigid and locked face shield, in case something impacts the facial area, but at the same time it is beneficial to have the face shield 7 be moveable in multiple directions and multiple positions to ensure that every face type can be accommodated easily.

Furthermore, sections of the padded inner surface can cover the side facing portions 5, the padded inner surface 3 can overlap with an edge of the face shield 7, further helping ensure that all the fragile body parts are covered.

Figure 4:
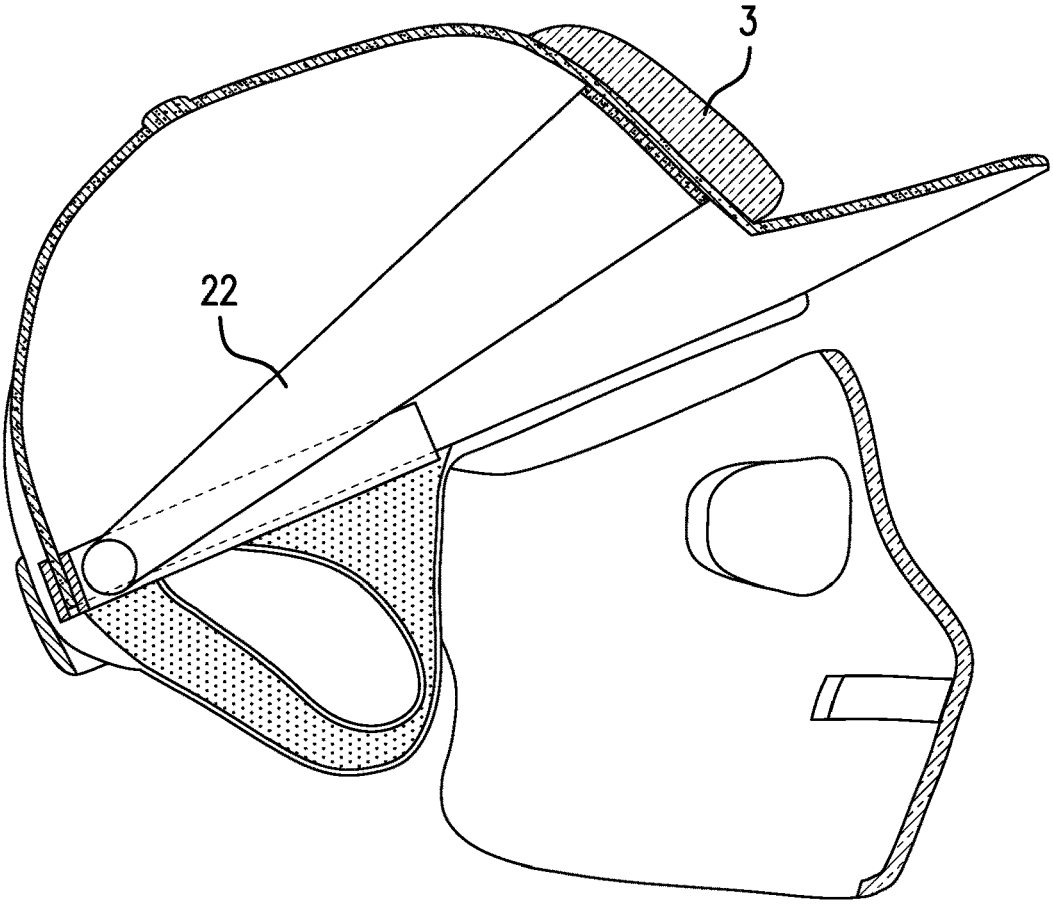
FIG. 4 shows a sectional side view of an embodiment of the invention.

FIG. 4 shows the interaction of the pre-existing cap and the protective case 2, along with the padded inner surface 3 that is located on an inner portion of the protective case 2.

The protective cap including both the rigid shell and the head cap may contain materials or sensors capable of measuring impact of a striking projectile that may be correlated with risk of concussion.

Furthermore, the head cover 22 may include a crystalline structure. This crystalline structure has a well-established impact memory. This structure can help doctors and coaches analyze the impact that player encountered and decide if a player should continue to play or needs to be taken out of a game. The analysis can be accomplished by providing a plug-in jack in the head cover 22 for a mechanism associated with sensing impacts. An analysis device may connect to the plug-in jack, download information captured by the impact sensing mechanism, and analyze the information. Alternatively, the analysis can also be accomplished by using various imaging techniques.

The protective cap 1 can include theranostic properties to aid in a diagnoses of a concussion through integration of crystals that are impact sensitive. The protective cap 1 may also include thermoregulatory features and provide a range of heating to cooling functionality.

In addition to the foregoing, other objects, features, aspects and advantages of the embodiments of the present invention will be better comprehended through a careful reading of a detailed description provided herein below with appropriate reference to the accompanying drawings.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A protective cap comprising:

a protective case including a rigid outer cover, wherein the rigid outer cover includes a forward facing portion, wherein the forward facing portion includes an aperture, and wherein a width of the aperture approximately equals a width of the forward facing portion;

a head cover coupled to the protective case, wherein the head cover fits within the protective case;

a face shield coupled to at least one track located on at least one of a pair of side facing portions of the protective case; and at least two open channels at a padded inner surface of the protective case, wherein the at least two open channels form at least a pair of coupling sections between the head cover and the rigid outer cover.

2. The protective cap of claim 1, wherein at least first and second portions of the protective case includes a level of permeability with the level of permeability of each of the first and second portions independently being either transparent or opaque.

3. The protective cap of claim 1, wherein the forward facing portion is reinforced, and wherein the aperture is uninterrupted.

4. The protective cap of claim 1, wherein a thickness of the forward facing portion is between about 0.5 cm and about 3 cm.

5. The protective cap of claim 1, wherein the face shield is moveable in an aft-forward direction.

6. The protective cap of claim 5, wherein the face shield is coupled to the protective case with a pair of hinges.

7. The protective cap of claim 6, wherein the pair of hinges allow rotational movement of the face shield.

8. The protective cap of claim 6, further comprising a lock on each of the pair of hinges allowing locking of the face shield in multiple lateral and rotational positions.

9. The protective cap of claim 1, wherein the rigid outer cover further includes a rear opening.

10. The protective cap of claim 9, wherein a width of the rear opening is less than the width of the aperture.

11. The protective cap of claim 9, wherein the rear opening is uninterrupted along a height of the rigid outer cover.

12. The protective cap of claim 9, further comprising a strap or other fixation device spanning the rear opening.

13. The protective cap of claim 12, wherein the strap or other fixation device is removably coupled to the protective cap.

14. The protective cap of claim 5, wherein the protective case further includes:

a padded inner surface, wherein sections of the padded inner surface cover the pair of the side facing portions, wherein the padded inner surface overlaps with an edge of the face shield, and wherein the padded inner surface covers between about 180 to about 360 degrees of an inside of the protective case.

15. The protective cap of claim 14, wherein the padded inner surface includes a foam based material.

16. The protective cap of claim 1, wherein the head cover includes a front opening, a rear opening, and a top opening.

17. The protective cap of claim 1, wherein the head cover includes a para-aramid synthetic fiber, and wherein the protective case is comprised of a different material than the head cover.

18. A protective cap for a head of an individual comprising:

a protective case, wherein the protective case includes a padded inner surface and a rigid outer cover, wherein the rigid outer cover includes a forward facing portion and a pair of side facing portions, wherein the forward facing portion includes an aperture, wherein the aperture includes a width approximately equal to a width of the rigid outer cover, wherein the rigid outer cover includes a rear opening, wherein a width of the rear opening is smaller than the width of the aperture, wherein the rear opening is uninterrupted along a height of the rigid outer cover, wherein the rigid outer cover includes a level of light permeability within a range from fully transparent to fully opaque, and a head cover coupled to the protective case, wherein the head cover fits within the protective case; and a face shield coupled to at least one track located on at least one of the pair of side facing portions of the protective case, wherein the face shield is moveable in an aft-forward direction, and wherein the face shield is coupled to the protective case with a pair of hinges; and at least two open channels at the padded inner surface, wherein the at least two open channels form at least a pair of coupling sections between the head cover and the rigid outer cover.

* * * * *